US007201680B2

(12) United States Patent
Takeuchi

(10) Patent No.: US 7,201,680 B2
(45) Date of Patent: Apr. 10, 2007

(54) RACKET FRAME

(75) Inventor: Hiroyuki Takeuchi, Hyogo (JP)

(73) Assignee: SRI Sports Limited, Kobe-shi (JP)

( * ) Notice: Subject to any disclaimer, the term of this patent is extended or adjusted under 35 U.S.C. 154(b) by 0 days.

(21) Appl. No.: 11/130,213

(22) Filed: May 17, 2005

(65) Prior Publication Data

US 2005/0272536 A1 Dec. 8, 2005

(30) Foreign Application Priority Data

May 18, 2004 (JP) ..... 2004-148316

(51) Int. Cl.
*A63B 49/00* (2006.01)

(52) U.S. Cl. ..... 473/523; 473/521; 473/537; 473/549

(58) Field of Classification Search ..... 473/520, 473/521, 523, 549, 537
See application file for complete search history.

(56) References Cited

U.S. PATENT DOCUMENTS

| | | | | |
|---|---|---|---|---|
| 3,941,380 | A | 3/1976 | Lacoste | |
| 5,362,046 | A * | 11/1994 | Sims | 473/300 |
| 5,865,694 | A * | 2/1999 | Duong-Van | 473/520 |
| 5,935,027 | A * | 8/1999 | Nashif et al. | 473/521 |
| 6,117,028 | A * | 9/2000 | You | 473/520 |
| 6,203,454 | B1 * | 3/2001 | Nashif et al. | 473/521 |
| 6,623,384 | B2 * | 9/2003 | Kanemitsu | 473/521 |
| 6,625,848 | B1 * | 9/2003 | Schneider | 16/436 |
| 6,767,297 | B2 * | 7/2004 | Hebreo et al. | 473/520 |
| 6,994,641 | B2 * | 2/2006 | Hebreo et al. | 473/520 |
| 2002/0058557 | A1 * | 5/2002 | Kanemitsu | 473/520 |
| 2005/0272536 | A1 * | 12/2005 | Takeuchi | 473/520 |

FOREIGN PATENT DOCUMENTS

| | | |
|---|---|---|
| JP | 5-213455 A | 8/1993 |
| JP | 2000-24140 A | 1/2000 |
| JP | 2003-164548 A | 6/2003 |

* cited by examiner

*Primary Examiner*—Raleigh W. Chiu
(74) *Attorney, Agent, or Firm*—Birch, Stewart, Kolasch and Birch, LLP

(57) ABSTRACT

A racket frame including a grip part, a shaft part, a throat part, and a head part formed hollowly with a fiber reinforced resin and having a weight not less than 100 g nor more than 270 g. The racket frame is provided with a dynamic damper comprising a mass member and a viscoelastic member mounted on a part of a peripheral surface of the mass member. The dynamic damper is mounted inside the grip part by fixing the viscoelastic member to a position of an inner wall of the grip part located within a range of 0.2 L from a free end of the grip part, supposing that a whole length of the racket frame is L in such a way that inside the grip part, at least one part of the mass member is shakable with respect to the inner wall of the grip part.

7 Claims, 11 Drawing Sheets

(⟶ hit with impact hammer )

PRIOR ART

PRIOR ART

RACKET FRAME

This nonprovisional application claims priority under 35 U.S.C. § 119(a) on Patent Application No(s). 2004-148316 filed in Japan on May 18, 2004, the entire contents of which are hereby incorporated by reference.

BACKGROUND OF THE INVENTION

1. Field of the Invention

The present invention relates to a racket frame and more particularly to a lightweight racket frame whose vibration-damping performance is enhanced and vibration-damping factor can be adjusted easily without using a heavy dynamic damper.

2. Description of the Related Art

In recent years, females and seniors demand a racket which hits a ball a long distance by applying a small power thereto. For example, a so-called "thick racket" which is thick in the out-of-plane direction (ball-hitting direction) in the ball-hitting plane of the racket frame is popular in a wide range of ages as well as females and seniors because the "thick racket" hits a ball a longer distance than conventional rackets. Therefore in recent years, rather than metal or wood, fiber reinforced resin which is lightweight, has a high specific strength, and has a high degree of freedom in design is used as a popular material of the racket frame. Thermosetting resin reinforced with carbon fiber or the like having a high strength and a high elastic modulus is popular as the fiber reinforced resin.

When the racket frame is lightweight by making it of this kind of fiber reinforced resin, the repulsion for a ball deteriorates because a kinetic energy to be transmitted to a ball at an impact time decreases. Further the vibration of the racket frame and an impact generated when the ball is hit are transmitted readily to a player's hand.

Recently a lightweight racket having a weight not more than 280 g is manufactured. When a lightweight racket having a weight not more than 250 g is designed, the racket is demanded to be lightweight and have high vibration-damping performance and shock-absorbing performance.

To improve the vibration-damping performance of the racket frame, various constructions having a dynamic damper mounted on the racket frame have been proposed.

For example, in the tennis rackets disclosed in Japanese Examined Patent Publication No. 52-13455 (patent document 1), as shown in FIG. 11, the cantilevered dynamic damper composed of the long and narrow elastic material is installed at the end of the grip. The base of the steel wire 2 having a weight 1 mounted on its front end is embedded in the racket frame.

In this construction, the dynamic damper is extended from the rear end of the racket. Thus the dynamic damper interferes with a player swinging a racket.

In Japanese Patent Application Laid-Open No. 2000-24140 (patent document 2), as shown in FIG. 12, the cap 6 to be mounted at the free end of the grip part 5 disposed at the position of the antinode of the amplitude of various vibration mode is improved. That is, a vibration-absorbing apparatus 6 whose vibration weight 6*b* is accommodated in the cavity 6*a* of the cap 6 is mounted at the free end of the grip part 5.

This construction contributes to damping of various vibration modes of the racket frame. Because the natural frequency is adjusted by the auxiliary weight, the weight of the vibration-absorbing apparatus increases much. Further the construction of the cap 6 makes it difficult to form a construction having a cover for the grip end. Thereby broken pieces generated in the hollow portion of the grip part tend to generate a sound.

In Japanese Patent Application Laid-Open No. 2003-164548 (patent document 3), as shown in FIG. 13, the balance-adjusting metal 8 is bonded to the concave groove 5*a* formed on the surface of the grip part 5 with a soft adhesive agent. The balance-adjusting metal 8 does not have a construction which easily vibrate, thereby having difficulty in resonating with various frequencies. As such the construction disclosed in the patent document 3 is incapable of providing a sufficient vibration-damping effect.

A construction is proposed in which the mass member is disposed at the head part of the racket frame. This construction causes the racket frame to be considerably heavy and the balance thereof to be large. Thus the racket frame has a low operability. A construction is proposed in which a vibration-absorbing member is disposed in a string hole. This construction causes the vibration-absorbing member to contact the string. Thus the vibration of the vibration-absorbing member is restricted. Consequently the vibration of the string is damped but the vibration of the racket frame cannot be damped sufficiently.

Patent document 1: Examined Patent Publication No. 52-13455

Patent document 2: Japanese Patent Application Laid-Open No. 2000-24140

Patent document 3: Japanese Patent Application Laid-Open No. 2003-164548

SUMMARY OF THE INVENTION

The present invention has been made in view of the above-described problems. Thus it is a first object of the present invention to provide a racket frame whose vibration-damping performance is enhanced without using a heavy dynamic damper and deteriorating its operability. It is a second object of the present invention to provide a racket frame whose vibration-damping factor can be adjusted easily.

To achieve the object, the present invention provides the present invention provides a racket frame including a grip part, a shaft part, a throat part, and a head part formed hollowly with a fiber reinforced resin and having a weight not less than 100 g nor more than 270 g. The racket frame is provided with a dynamic damper comprising a mass member and a viscoelastic member mounted on a part of a peripheral surface of the mass member. The dynamic damper is mounted inside the grip part by fixing the viscoelastic member to a position of an inner wall of the grip part located within a range of 0.2 L from a free end of the grip part, supposing that a whole length of the racket frame is L in such a way that inside the grip part, at least one part of the mass member is shakable with respect to the inner wall of the grip part.

The racket frame is composed of a pipe composed of layered prepregs containing resin and arranged reinforcing fibers impregnated with the resin. The dynamic damper is fixed to the inner wall of the grip part through the viscoelastic member of the dynamic damper, with the dynamic damper disposed at a position in the hollow portion of the grip part near the grip end, namely, at the position located within the range of 0.2 L from the grip end corresponding to the antinode of various vibration mode.

Because the dynamic damper is disposed at the position where the amplitude is large, the dynamic damper is capable of enhancing the vibration-damping performance. Further because the dynamic damper is disposed inside the grip part, the dynamic damper does not interfere with a player swinging a racket and allows the racket frame to be handled favorably.

It is favorable that the mass member of the dynamic damper is rod-shaped; the viscoelastic member having a predetermined thickness is fixed to a central portion of the mass member in a longitudinal direction thereof; and both end portions of the mass member are shakable. It is more favorable that a stepped small-diameter portion is formed at the central portion of the rod-shaped mass member in its longitudinal direction and that a sheet consisting of the viscoelastic member is fixedly wound around the small-diameter portion.

The above-described construction causes the weight of the mass member to concentrate at both ends thereof in its longitudinal direction. Thereby the mass member vibrates easily, thus providing a high vibration-damping effect. Because the viscoelastic member is wound around the small-diameter portion, it is possible to prevent the mass member from being removed from the viscoelastic member while the racket frame is vibrating. It is possible to fix an approximately cubic viscoelastic member to a portion of the peripheral surface of the mass member. Regardless of whether the viscoelastic member is sheet-shaped or cubic, the viscoelastic member is bonded to the inner wall of the grip part, whereas the mass member is constructed shakably so that the dynamic damper performs its function.

It is preferable that the dynamic damper is mounted inside the grip part with the longitudinal direction of the mass member of the dynamic damper parallel with the axial direction of the grip part. Thereby the mass member resonates with the racket frame, thereby damping the vibration of the racket frame effectively. It is possible to dispose the dynamic damper at opposed left and right positions of a plane including the axis of the grip part and parallel with the ball-hitting plane and/or at opposed upper and lower positions of a plane including the axis of the grip part and orthogonal to the ball-hitting plane F. The dynamic damper is capable of having a high vibration-absorbing performance by mounting it at a plurality of positions inside the grip part.

Nylon 11 or nylon 12 may be used as the material of the mass member in terms of moldability. Alternatively it is preferable to use thermoplastic resin such as nylon 66 containing carbon fiber (content: 15 to 30%) or metal powder such as tungsten. Metal materials such as iron, copper, nickel, and tungsten may be also used as the material of the mass member.

It is preferable that the rod-shaped mass member has a weight not less than 2 g nor more than 10 g and a length not less than 2 cm nor more than 5 cm. If the mass member has a weight less than 2 g, it is difficult for the frequency of the racket frame and that of the mass member to be coincident with each other. Thereby it is impossible for the dynamic damper to provide a sufficient vibration-damping effect. On the other hand, if the mass member has a weight more than 10 g, there is a high possibility that the weight of the dynamic damper is heavier than the weight of a lead mounted on the conventional racket frame to adjust the weight and balance of the racket frame. If the mass member has a length shorter than 2 cm, it is difficult for the mass member to shake. Thereby it is impossible for the dynamic damper to provide a sufficient vibration-damping effect. On the other hand, if the mass member has a length more than 5 cm, the mass member shakes so much that it collides with the inner wall of the grip part, thus causing the generation of noise.

It is preferable that the viscoelastic member has a thickness not less than 2 mm nor more than 4 mm and a complex elastic modulus not less than 2.0E+07 dyn/cm$^2$ nor more than 1.0E+10 dyn/cm$^2$ at a temperature in a range of 0° C. to 10° C. when the complex elastic modulus is measured at a frequency of 10 Hz.

If the viscoelastic member has a thickness less than 2 mm, the viscoelastic member is incapable of providing sufficient repulsion performance and vibration-absorbing performance. On the other hand, if the viscoelastic member has a thickness more than 4 mm, the weight of the racket frame will increase and the operability thereof will deteriorate.

If the complex elastic modulus of the viscoelastic member is less than 2.0E+07 dyn/cm$^2$ at a temperature in the range of 0° C. to 10° C. when the complex elastic modulus is measured at a frequency of 10 Hz, the viscoelastic member is so soft that the rod-shaped mass member will collide with the inner wall of the racket frame and generate noise easily. On the other hand, if the complex elastic modulus of the viscoelastic member is more than 1.0E+10 dyn/cm$^2$, the frequency of the mass member and that of the racket frame are not coincide with each other. Thus the dynamic damper does not perform its function.

It is preferable that the dynamic damper-mounting hole is formed on a portion of a wall surface of the grip part; the viscoelastic member of the dynamic damper is fixed to an inner surface of a separable grip member made of fiber reinforced resin; and the dynamic damper-mounting hole is closed with the separable grip member in such a way that the separable grip member and an outer surface of the grip part are flush with each other.

More specifically, when the grip part is punched to form the dynamic damper-mounting hole, a stepped supporting portion is formed on the edge of the dynamic damper, and the flat separable grip member is mounted on the edge of the dynamic damper-mounting hole with an adhesive agent or pressure sensitive adhesive double coated paper. Thereby it is easy to mount the dynamic damper at a correct position and in a correct orientation inside the grip part. That is, the dynamic damper can be mounted inside the grip part with a high operability. When the dynamic damper-mounting hole is so constructed that the separable grip member is bonded thereto with the pressure sensitive adhesive double coated paper, it is easy to install the dynamic damper on the dynamic damper-mounting hole and remove it therefrom. Thereby it is easy to adjust the vibration-damping factor by exchanging the dynamic dampers having different specifications with one another. In addition, it is possible to provide the dynamic damper-mounting hole at a plurality of positions so that the position of the dynamic damper and number of the dynamic dampers can be selected easily. Thereby the vibration-damping factor can be adjusted.

It is preferable that similarly to the construction of the grip part, the separable grip member is made of a laminate of prepregs in the shape of a flat plate.

As described above, according to the present invention, the dynamic damper is disposed within the range of 0.2 L from the grip end, the dynamic damper is capable of damping frequencies of all vibration modes of the racket frame. Further since the dynamic damper is mounted inside the grip part without increasing the weight and balance of the racket frame, the dynamic damper does not interfere with a player swinging a racket, thus allowing the player to handle a racket with a high operability.

The dynamic damper-mounting hole can be easily fixed to the inner wall of the grip part by forming the dynamic damper-mounting hole through the wall of the grip part and bonding the dynamic damper to the separable grip member. In addition, since the dynamic damper-mounting hole is formed at a plurality of positions, the position of the dynamic damper and number of the dynamic dampers can be selected. Thereby the vibration-damping factor can be adjusted easily.

BRIEF DESCRIPTION OF THE DRAWINGS

FIG. 6 shows main portions of a racket frame of a second embodiment of the present invention, in which

FIG. 7 shows main portions of a racket frame of a third embodiment of the present invention, in which

FIG. 8 shows main portions of a racket frame of a fourth embodiment of the present invention, in which

DETAILED DESCRIPTION OF THE PREFERRED EMBODIMENTS

Figure 1:
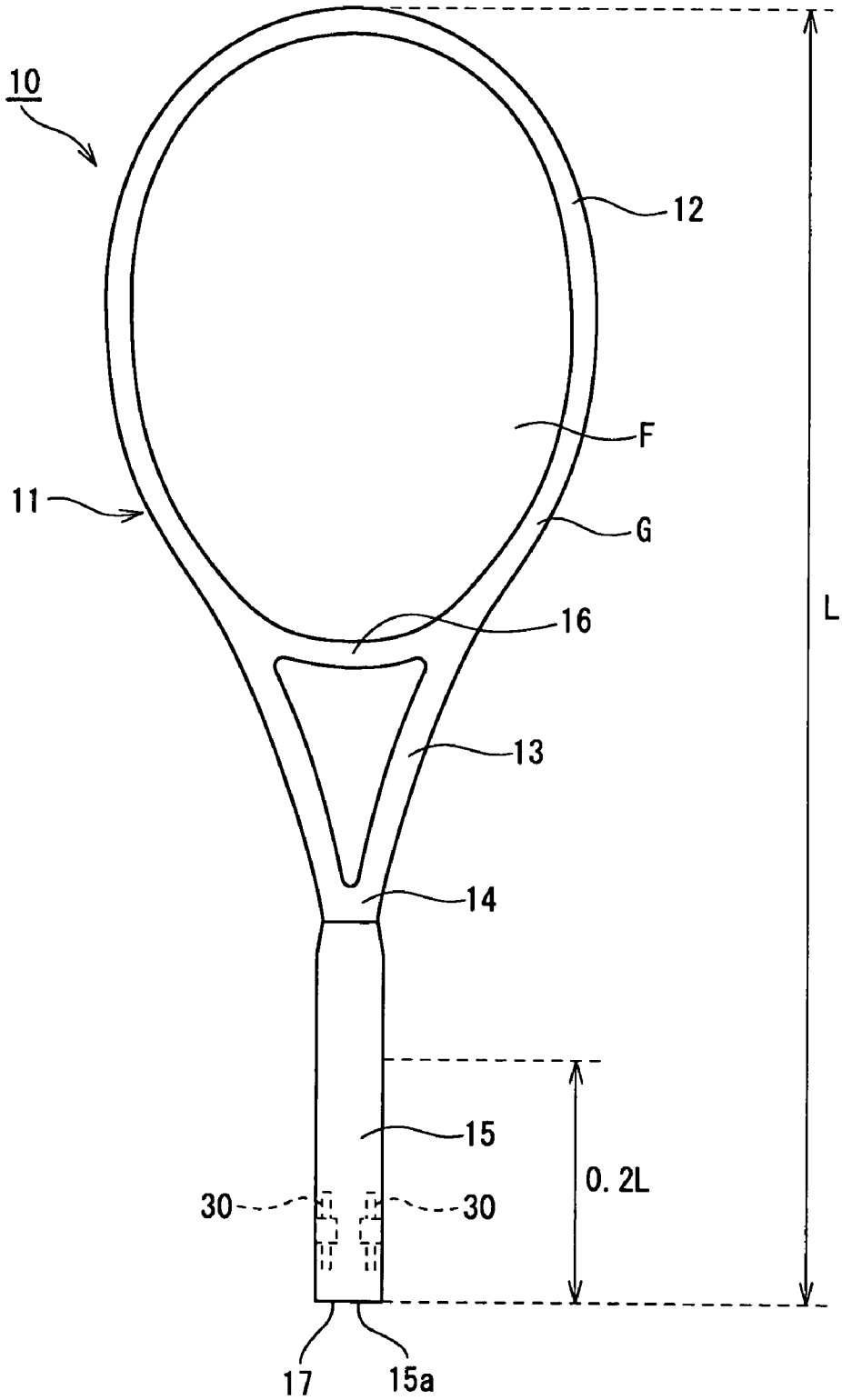
FIG. 1 is a plan view showing a racket frame according to a first embodiment of the present invention.
Figure 2:
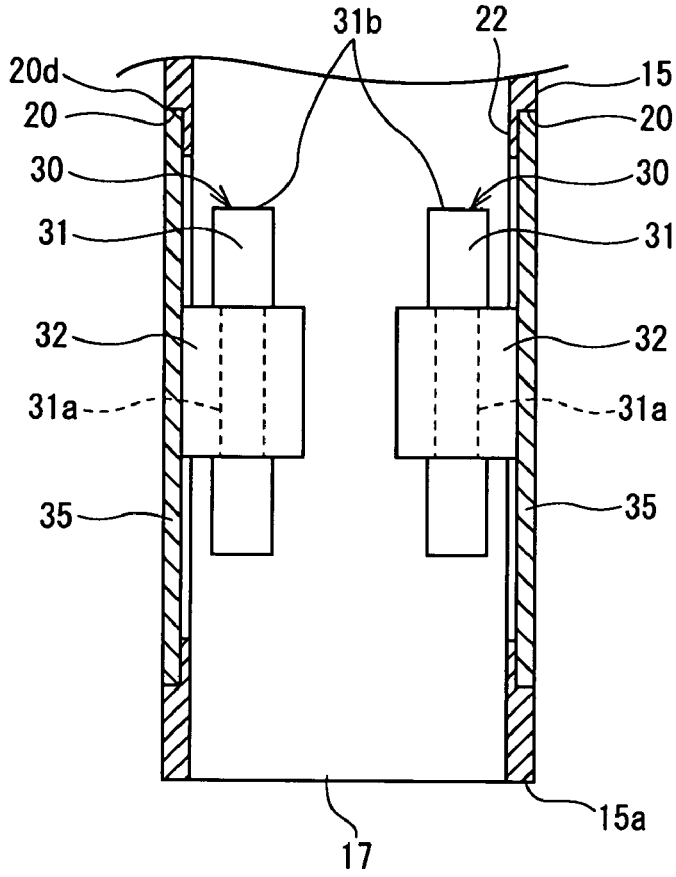
FIG. 2 is a sectional view showing main portions of the racket frame shown in FIG. 1 parallel with a ball-hitting plane thereof.
Figure 3:
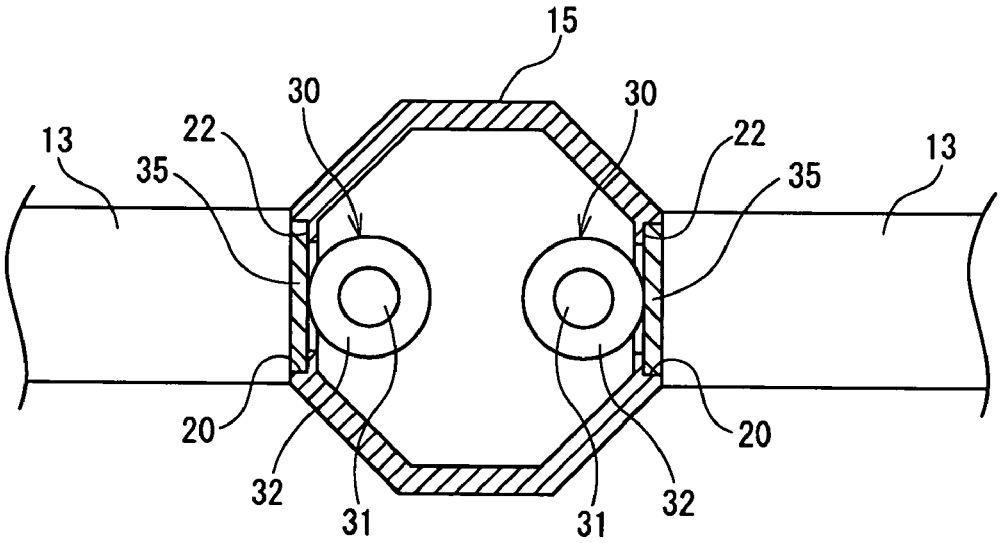
FIG. 3 is a sectional view showing main portions of the racket frame shown in FIG. 1 orthogonal to the axis of a grip part thereof.

The embodiments of the present invention will be described below with reference to drawings. The embodiments apply to a racket frame for regulation-ball tennis.

FIGS. 1 through 5 show a racket frame 10 of a first embodiment of the present invention. In the racket frame 10, a dynamic damper 30 fixed to the inner surface of a separable grip member 35 is inserted into a dynamic damper-mounting hole 20 formed in penetration through the grip part 15 of a frame body 11.

The frame body 11 is composed of a head part 12, a throat part 13, a shaft part 14, and a grip part 15. These parts are continuously formed. One end of a yoke 16 is connected to the throat part 13 at its one side, whereas the other end of the yoke 16 is connected to the throat part 13 at its other side. The yoke 16 and the head part 12 form a string-stretching part G surrounding a ball-hitting plane F of the racket frame 10. It is preferable that the whole length L of the racket frame 10 is in the range of 660 to 740 mm. In the first embodiment, the whole length L of the racket frame 10 is set to 700 mm. The frame body 11 is composed of a laminate of prepregs in which arranged reinforcing fibers are impregnated with resin. It is preferable that the weight of frame body 11 is set to 170 g to 270 g. In the first embodiment, the weight of the racket frame 10 is set to 200 g to 245 g.

An end cap (not shown) is mounted on an open portion 17 of a free end 15*a* of the grip part 15.

Figure 5A:
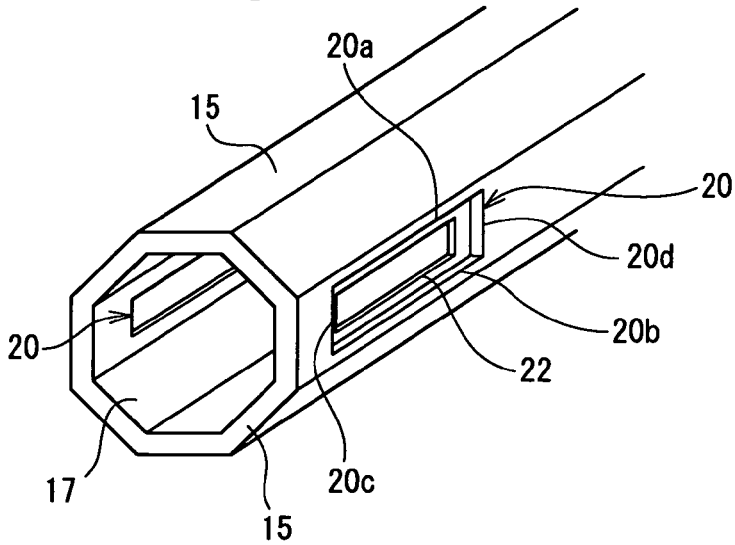
FIGS. 5A, 5B, and 5C show the procedure of mounting the dynamic damper on a predetermined position of the racket frame shown in FIG. 1.

As shown in FIG. 5A, two rectangular dynamic damper-mounting holes 20 (hereinafter referred to as merely mounting hole 20) are formed in penetration through the grip part 15 in the axial direction of the grip part 15 by punching the grip part 15 at two positions which are opposed to each other in the widthwise direction of the grip part 15 in such a way that the dynamic damper-mounting holes 20 are formed on a plane parallel with the ball-hitting plane F. It is preferable that the length of longer sides 20*a*, 20*b* of the mounting hole 20 is set to 15 to 40 mm and that the length of shorter sides 20*c*, 20*d* of the mounting hole 20 is set to 3 to 20 mm. In the first embodiment, the length of the longer sides 20*a*, 20*b* of the mounting hole 20 is set to 26 to 30 mm and that the length of the shorter sides 20*c*, 20*d* thereof is set to 6 to 8 mm. It is preferable that the longer sides 20*a*, 20*b* of the mounting hole 20 are parallel with the axis of the grip part 15 and that the shorter side 20*c* thereof disposed at the grip-end side is spaced at 30 mm to 140 mm from the free end 15*a* of the grip part 15. In the first embodiment, the shorter side 20*c* is spaced at 60 mm from the free end 15*a* of the grip part 15. A supporting portion 22 is formed along the edge of the mounting hole 20 at its bottom. It is preferable that the distance between the shorter side 20*c* of the mounting hole 20 disposed at the grip-end side and the free end 15*a* of the grip part 15 is in the range of 0.01 L to 0.2 L of the whole length L of the racket frame 10.

Figure 4A:
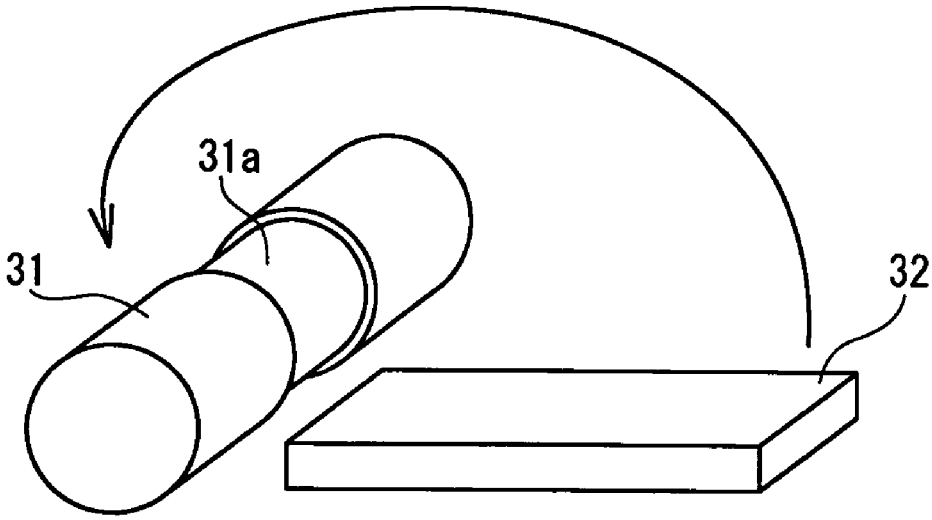
FIG. 4A is an exploded perspective view showing a dynamic damper.

As shown in FIG. 4A, the dynamic damper 30 is composed of a rod-shaped mass member 31 and a viscoelastic sheet 32 wound fixedly around the peripheral surface of the rod-shaped mass member 31.

In the first embodiment, the mass member 31 is made of nylon 66 containing short carbon fibers at 22% and is cylindrical. The mass member 31 has a stepped small-diameter portion 31*a* formed at its central portion in its longitudinal direction. The diameter of the small-diameter portion 31*a* is smaller than that of the other parts of the mass member 31. The mass member 31 has a length of 3 cm and a weight of 3 g.

In the first embodiment, the sheet-shaped viscoelastic sheet 32 is formed by vulcanizing and molding a rubber composition containing 100 parts by weight of styrene-butadiene rubber, 1.5 parts by weight of sulfur, and 40 parts by weight of carbon black. The viscoelastic sheet 32 is fixedly wound around the peripheral surface of the mass member 31. The viscoelastic member has a thickness not less than 2 mm nor more than 4 mm and a complex elastic modulus not less than 2.0E+07 dyn/cm$^2$ nor more than 1.0E+10 dyn/cm$^2$ at a temperature in a range of 0° C. to 10° C. when the complex elastic modulus is measured at a frequency of 10 Hz. The viscoelastic sheet 32 has a thickness of 2 mm and a weight of 1 g.

Figure 4B:
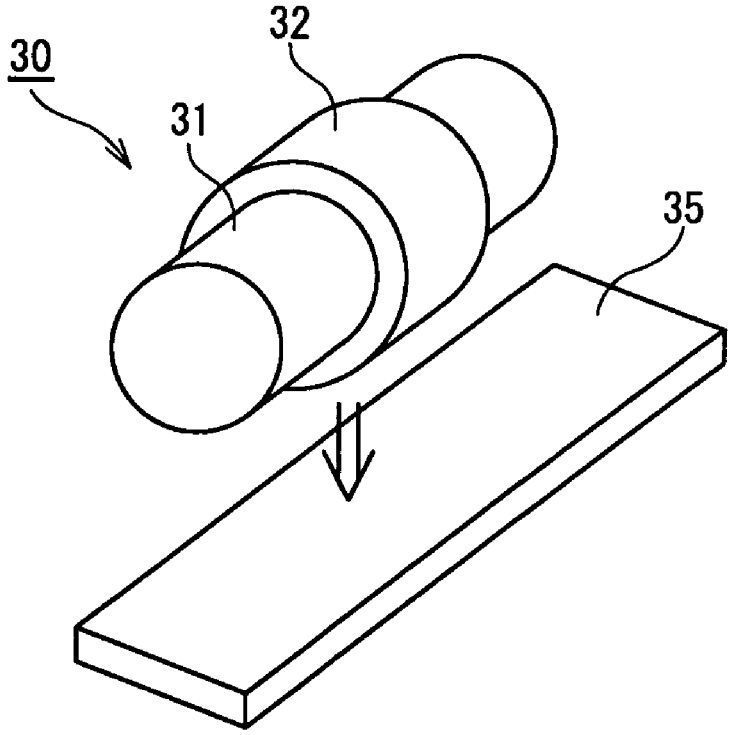
FIG. 4B is an exploded perspective view showing the dynamic damper and a flat plate.

To fix the dynamic damper 30 having the above-described construction to the inner wall surface of the grip part 15, as shown in FIG. 4B, a part of the viscoelastic sheet 32 wound around the peripheral surface of the mass member 31 of the dynamic damper 30 is fixed to a surface of a separable grip member 35 consisting of a flat plate made of fiber reinforced resin with an adhesive agent.

The separable grip member 35 serves as a cover member for closing the mounting hole 20. The separable grip member 35 is formed rectangularly in correspondence to the configuration and thickness of the mounting hole 20. The dynamic damper 30 is fixed to the mounting hole 20 with the longer sides 35*a*, 35*b* thereof parallel with the axis of the mass member 31. Similarly to the construction of the grip part 15, the separable grip member 35 is made of a laminate of prepregs.

Figure 5B:
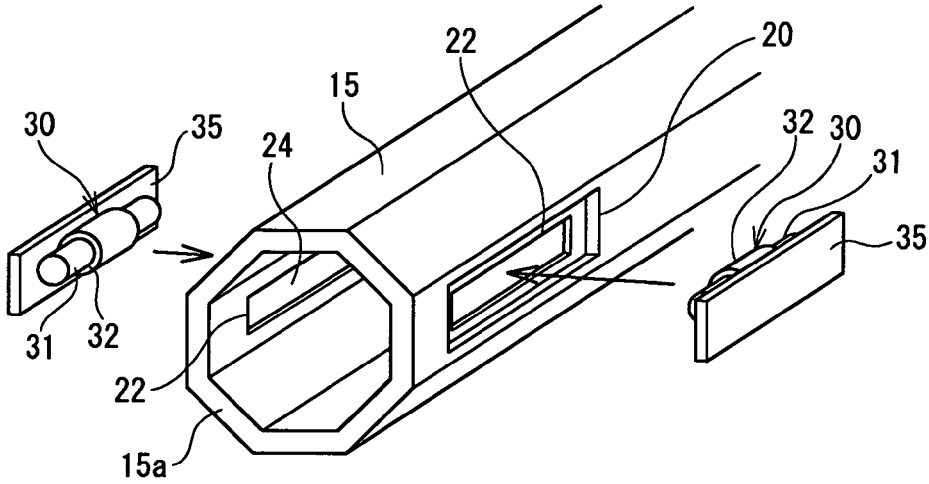
Figure 5C:
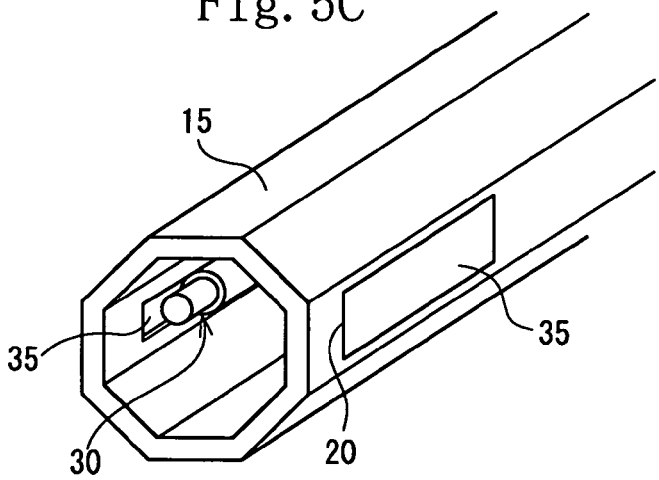

As shown in FIGS. 5A, 5B, and 5C, the dynamic damper 30 is inserted into the left and right mounting holes 20 of the grip part 15, with the mass member 31 fixed to the separable grip member 35 through the viscoelastic sheet 32. After pressure sensitive adhesive double coated paper (not shown) is fixed to the edge of the separable grip member 35, the separable grip member 35 is fixed to the supporting portion 22 through the pressure sensitive adhesive double coated paper. In this state, the outer surface of the separable grip member 35 is flush with that of the grip part 15.

The total of the weight of the left dynamic damper 30 and that of the right dynamic damper 30 is 8 g, whereas the weight of a lead mounted on the conventional racket frame to adjust the weight and balance of the racket frame is about 10 g heavier than the dynamic damper 30. Because the dynamic damper 30 is mounted inside the grip part 15, the dynamic damper 30 does not interfere with a player swinging a racket. Therefore the dynamic damper 30 allows the racket frame 10 to have a favorable vibration-damping performance and operability.

The dynamic damper 30 is mounted in the mounting hole 20 of the grip part 15 after the dynamic damper 30 is fixed to the inner surface of the separable grip member 35. Thus the dynamic damper 30 can be mounted in the mounting hole 20 easily from the outside. Therefore it is easy to exchange one dynamic damper with another dynamic damper when the weight, length, and material of the mass member 31 of the former are different from those of the mass member 31 of the latter and/or the thickness and material of the viscoelastic member 32 of the former are different from those of the viscoelastic member 32 of the latter. Thereby the vibration-damping factor can be easily adjusted.

The dynamic damper 30 is mounted in the mounting hole 20 with the longitudinal direction of the mass member 31 parallel with the axial direction of the grip part 15. Thereby when a ball is hit with a racket, the mass member 31 vibrates readily and thus the dynamic damper 30 provides an effective vibration-damping effect. Because the mass member 31 has a length of 3 cm which is not long, it does not collide with the inner wall surface of the grip part 15 even when the dynamic damper 30 vibrates vigorously. Thus it is possible to prevent noise from being generated. Because the viscoelastic member 32 is wound around the small-diameter portion 31*a* formed at the central portion of the mass member 31, it is possible to prevent the mass member 31 from being removed from the viscoelastic member 32, even when the mass member 31 vibrates vigorously.

In addition, it is preferable that the head-side shorter side 20*d* of the mounting hole 20 is spaced by 30 mm to 140 mm from the free end 15*a* of the grip part 15. To this end, supposing that the whole length of the racket frame 10 is L, the mounting hole 20 is disposed within the range of 0.2 L from the free end 15*a*, and the head-side end 31*b* of the dynamic damper 30 is also disposed within the range of 0.2 L. Thereby the dynamic damper 30 is disposed at the position of the antinode where the amplitude of various vibration mode is large, thus enhancing the vibration-damping performance effectively.

In the first embodiment, the head-side shorter side 20*d* of the mounting hole 20 is spaced at 60 mm from the free end 15*a* of the grip part 15.

The viscoelastic member 32 of the dynamic damper 30 has a thickness not less than 2 mm nor more than 4 mm. Thus the dynamic damper 30 does not increase the weight of the racket frame and is capable of displaying the vibration-absorbing performance sufficiently. The viscoelastic member has a complex elastic modulus not less than 2.0E+07 dyn/cm$^2$ nor more than 1.0E+10 dyn/cm$^2$ at a temperature in a range of 0° C. to 10° C. when the complex elastic modulus is measured at a frequency of 10 Hz. Therefore, the mass member 31 is not so soft as to collide with the inner wall surface of the grip part 15. Further, the frequency of the mass member 31 is coincident with that of the racket frame. Thus the mass member 31 allows the racket frame to have a proper vibration-damping effect.

Figure 6A:
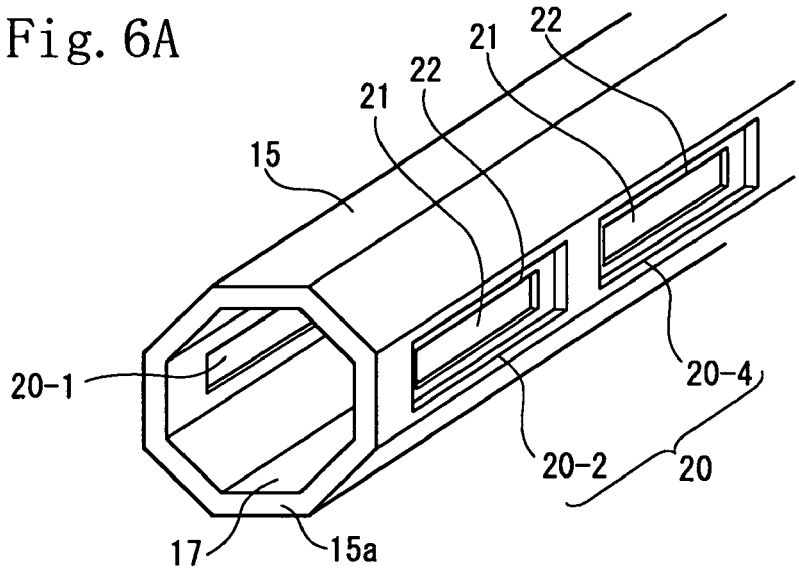
FIG. 6A is a perspective view showing a state in which dynamic dampers have not been mounted inside a grip part.
Figure 6B:
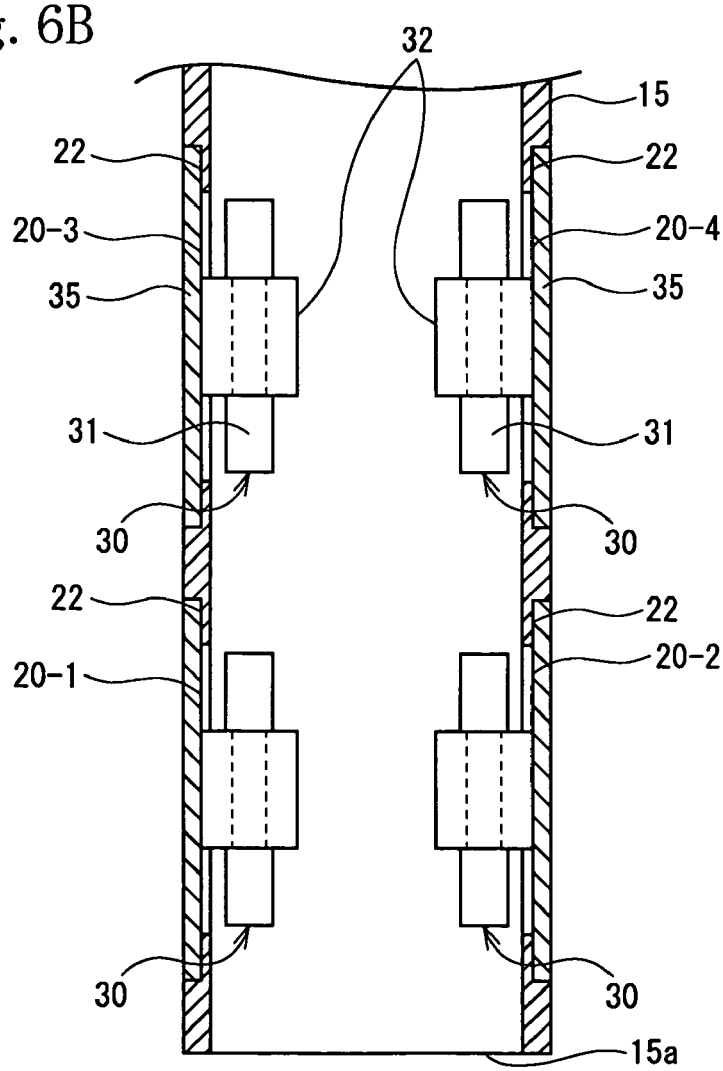
FIG. 6B is a sectional view parallel with a ball-hitting plane of the racket frame after the dynamic dampers are mounted inside the grip part.

FIGS. 6A and 6B show a second embodiment of the present invention.

Two rectangular mounting holes 20 are formed in penetration through the grip part 15 in the axial direction thereof at two positions thereof which are opposed to each other in the widthwise direction thereof in such a way that the dynamic damper-mounting holes 20 are formed on a plane parallel with the ball-hitting plane F. More specifically, four mounting holes 20-1 through 20-4 are formed in penetration through the grip part 15. The dynamic damper 30 is mounted in each of the four mounting holes 20-1 through 20-4 by embedding the flat plate-shaped separable grip member 35 in each of the mounting holes 20-1 through 20-4, with the dynamic damper 30 fixed to the separable grip member 35.

As described above, the racket frame of the second embodiment has the same construction as that of the first embodiment except that the four mounting holes 20-1 through 20-4 are formed by disposing them within the range of 0.2 L from the free end 15*a* of the grip part 15.

Figure 7A:
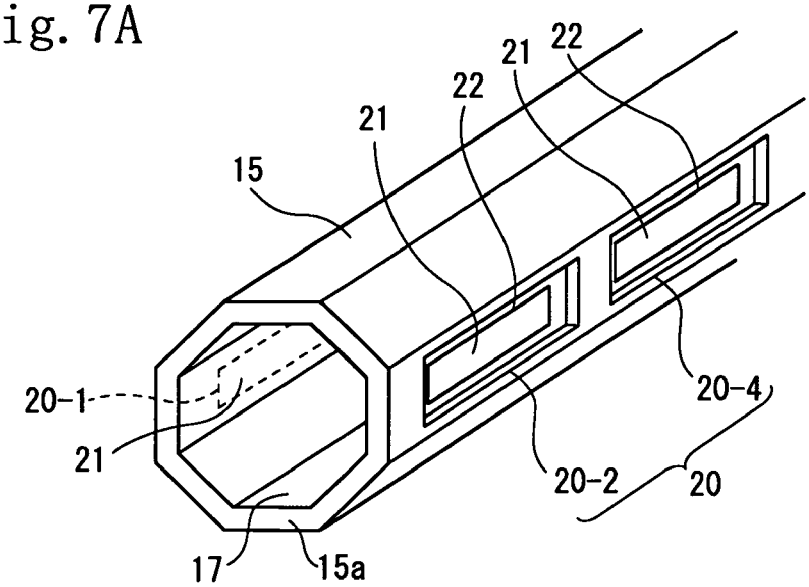
FIG. 7A is a plan view showing a state in which dynamic dampers have not been mounted inside a grip part.
Figure 7B:
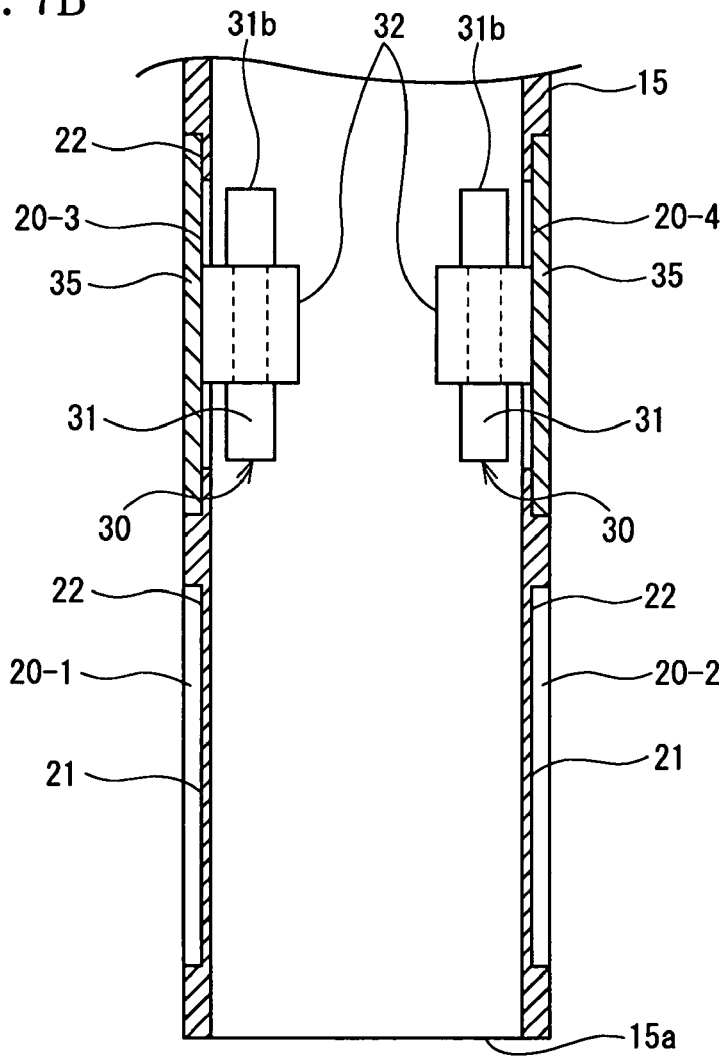
FIG. 7B is a sectional view orthogonal to the axis of the grip part after the dynamic dampers are mounted inside the grip part.

In a third embodiment shown in FIGS. 7A and 7B, the dynamic damper can be mounted at four positions of the grip part 15. The four mounting holes 20-1 through 20-4 are formed as thin concavities. Only necessary concavities are punched to form the mounting holes 20-1 through 20-4 in which the dynamic damper is mounted, whereas concavities in which the dynamic damper is not mounted are not punched. This construction allows the dynamic damper to be mounted on desired mounting holes 20-1 through 20-4.

Figure 8A:
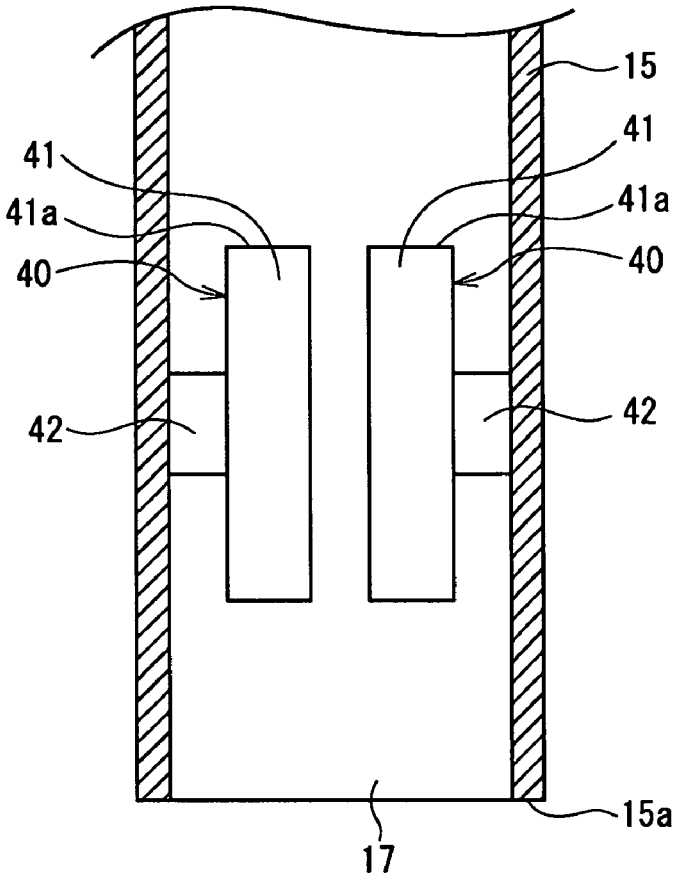
FIG. 8A is a sectional view parallel with the ball-hitting plane of the racket frame.
Figure 8B:
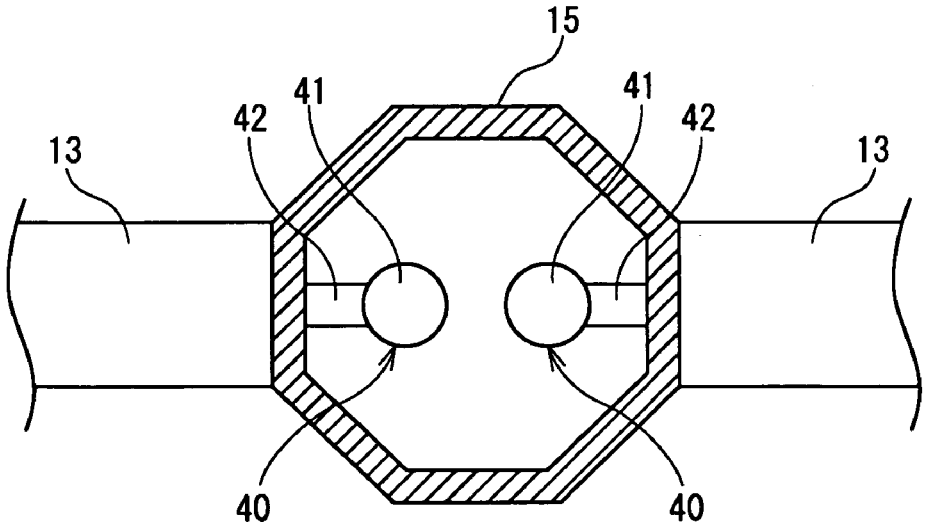
FIG. 8B is a sectional view orthogonal to the axis of the grip part.

FIGS. 8A and 8B show a fourth embodiment of the present invention. The fourth embodiment has the same construction as that of the first embodiment except that the construction of a dynamic damper 40 is different from that of the dynamic damper 30 of the first embodiment and that the method of mounting the dynamic damper 40 inside the grip part 15 is different from that of mounting the dynamic damper 30 of the first embodiment. Thus the same parts of the fourth embodiment as those of the first embodiment are denoted by the same reference numerals and symbols as those of the first embodiment.

Unlike the first embodiment, the mounting hole 20 is not formed in penetration through the grip part 15 in the fourth embodiment, but the dynamic damper 40 is inserted into the grip part 15 from an open portion 17 disposed at the free end 15*a* of the grip part 15 and is fixed directly to left and right inner walls of the grip part 15.

More specifically, the dynamic damper 40 is mounted on left and right positions of the grip part 15 which are opposed to each other in the widthwise direction thereof in such a way that the dynamic dampers 40 are disposed on a plane including the axis of the grip part 15 and parallel with the ball-hitting plane F, with the longitudinal direction of a mass member 41 which will be described later parallel with the axial direction of the grip part 15 and with ahead-side end 41*a* of the mass member 41 disposed within the range of 0.2 L from the free end 15*a* of the grip part 15.

The dynamic damper 40 is composed of the mass member 41 and a viscoelastic member 42. The mass member 41 is formed as a cylindrical rod made of nylon 66 containing short carbon fibers at 22%. The mass member 41 has a length of 30 mm and a weight of 3 g.

The viscoelastic member 42 is substantially cubic and fixed to the outer surface of the mass member 41 at the central portion thereof. The viscoelastic member 42 is formed by vulcanizing and molding a rubber composition containing 100 parts by weight of styrene-butadiene rubber, 1.5 parts by weight of sulfur, and 40 parts by weight of carbon black. The viscoelastic member 42 has a complex elastic modulus not less than 2.0E+07 dyn/cm$^2$ nor more than 1.0E+10 dyn/cm$^2$ at a temperature in the range of 0° C. to 10° C. when the complex elastic modulus is measured at a frequency of 10 Hz.

The dynamic damper 40 is mounted inside the grip part 15 by fixing the surface of the viscoelastic member 42 opposite to the surface thereof fixed to the mass member 41 to the inner surface of the grip part 15. After the dynamic damper 40 is mounted on the inner surface of the grip part 15, the open portion 17 of the grip part 15 is closed with an end cap (not shown).

In the fourth embodiment as well as in the above-described embodiments, the dynamic damper 40 is resonant with the racket frame when a ball is hit, thus damping the vibration of the racket frame 10. Because the dynamic damper 40 is accommodated inside the grip part 15, the dynamic damper 40 does not interfere with a player swinging a racket nor increase the weight of the racket frame. Therefore the dynamic damper 40 allows the racket frame to have a high vibration-damping performance and the player to handle it favorably.

EXAMPLES

To check the above-described operation and effect of the racket frame of the present invention, the racket frames of examples 1 through 9 of the present invention and those of comparison examples 1 through 9 will be described below.

As shown in table 1, the prepared racket frames of the examples 1 through 9 and the comparison examples 1 through 9 were different from one another in each of the mounting position of the dynamic damper (distance from the free end of the grip part); the mounting portion (horizontally or vertically); the material (kind), length, and weight of the mass member; and the material, complex elastic modulus, thickness, and weight of the viscoelastic member (rubber). The moment of inertia and vibration-damping factor of each racket frame were measured. A ball-hitting test was conducted to examine the operability and vibration-damping performance of each racket frame.

The mounting position of the dynamic damper shown in table 1 is indicated by the distance from the free end 15*a* of the grip part 15 of the racket frame 10 to the head-side end 31*b* of the mass member 31, supposing that the whole length of the racket frame 10 is L.

The complex elastic moduli of the viscoelastic members were measured in the following conditions by using a measuring apparatus DVE-V4 manufactured by Reology Inc. The complex elastic moduli shown in table 1 are representatively indicated by numerical values obtained by measuring them at 5° C. The complex elastic moduli of the viscoelastic members of the examples 1 through 9 were not less than 2.0E+7 dyn/cm$^2$ nor more than 1.0E+10 dyn/cm$^2$ at temperatures in a range of 0° C. to 10° C.

Specimen: 5 mm (width)×30 mm×(length)×2 mm (thickness)

Length of deformed portion of the specimen: 20 mm (specimens were held at both longitudinal ends thereof in the range 5 mm)

Initial strain: 10% (2 mm)

Amplitude: 12 μm

Frequency: 10 Hz

Mode: tensile mode

TABLE 1

| | | Examination of disposition | | | | |
|---|---|---|---|---|---|---|
| | | Comparison example ① | Example ① | Example ② | Comparison example ② | Example ③ |
| Mounting position of dynamic damper | | Not provided | 0.1L | 0.2L | 0.3L | 0.1L |
| Mounting portion (horizontally or vertically) | | | One at left-hand side and one at right-hand side | One at left-hand side and one at right-hand side | One at left-hand side and one at right-hand side | One at upper side and one at lower side |
| Mass member | kind | Lead | 6,6-NY + C | 6,6-NY + C | 6,6-NY + C | 6,6-NY + C |
| | Length [mm] | | 30 | 30 | 30 | 30 |
| | Weight [g] | | 3 × 2 | 3 × 2 | 3 × 2 | 3 × 2 |
| Viscoelastic member | kind | Lead | SBR + carbon | SBR + carbon | SBR + carbon | SBR + carbon |
| | Complex elastic modulus [dyn/cm$^2$] | | 3.86E + 08 | 3.6E + 08 | 3.86E + 08 | 3.86E + 08 |
| | Thickness [mm] | | 2 | 2 | 2 | 2 |
| | Weight [g] | | 1 × 2 | 1 × 2 | 1 × 2 | 1 × 2 |
| Weight | [g] | 245 | 245 | 245 | 245 | 245 |
| Balance | [mm] | 360 | 360 | 361 | 362 | 360 |
| Moment of inertia | Is (swing direction) [g/cm$^2$] | 467,000 | 467,000 | 468,000 | 469,000 | 467,000 |

TABLE 1-continued

| | | | | | | |
|---|---|---|---|---|---|---|
| | Ic (center direction) [g/cm$^2$] | 16,400 | 16,400 | 16,500 | 16,600 | 16,400 |
| Vibration-damping factor | Out-of-plane primary [%] | 0.30 | 0.88 | 0.66 | 0.40 | 0.79 |
| | Out-of-plane secondary [%] | 0.30 | 1.75 | 1.32 | 0.41 | 1.50 |
| Evaluation by hitting | Operability | 4.1 | 4.0 | 3.9 | 3.8 | 3.0 |
| | Vibration-absorbing performance | 2.8 | 4.3 | 4.0 | 3.0 | 4.2 |

| | | Examination of weight and length | | | | | |
|---|---|---|---|---|---|---|---|
| | | Example ④ | Comparison example ③ | Example ⑤ | Comparison example ④ | Comparison example ⑤ | Example ⑥ |
| Mounting position of dynamic damper | | 0.1L | 0.1L | 0.1L | 0.1L | 0.1L | 0.1L |
| Mounting portion (horizontally or vertically) | | One at left-hand side and one at right-hand side | One at left-hand side and one at right-hand side | One at left-hand side and one at right-hand side | One at left-hand side and one at right-hand side | One at left-hand side and one at right-hand side | One at left-hand side and one at right-hand side |
| Mass member | kind | 11-NY | Copper | 11-NY | 11-NY | Copper | 6,6-NY + W |
| | Length [mm] | 30 | 15 | 45 | 60 | 30 | 30 |
| | Weight [g] | 1.5 × 2 | 3 × 2 | 2 × 2 | 3 × 2 | 6 × 2 | 4 × 2 |
| Viscoelastic member | kind | SBR + carbon | SBR + carbon | SBR + carbon | SBR + carbon | SBR + carbon | SBR + carbon |
| | Complex elastic modulus [dyn/cm$^2$] | 3.86E + 08 | 3.86E + 08 | 3.86E + 08 | 3.86E + 08 | 3.86E + 08 | 3.86E + 08 |
| | Thickness [mm] | 2 | 2 | 2 | 2 | 2 | 2 |
| | Weight [g] | 1 × 2 | 1 × 2 | 1 × 2 | 1 × 2 | 1 × 2 | 1 × 2 |
| Weight | [g] | 245 | 245 | 245 | 245 | 250 | 245 |
| Balance | [mm] | 360 | 360 | 360 | 360 | 357 | 360 |
| Moment of inertia | Is (swing direction) [g/cm$^2$] | 467,000 | 467,000 | 467,000 | 467,000 | 476,000 | 467,000 |
| | Ic (center direction) [g/cm$^2$] | 16,400 | 16,400 | 16,400 | 16,400 | 16,700 | 16,400 |
| Vibration-damping factor | Out-of-plane primary [%] | 0.62 | 0.41 | 0.70 | 0.45 | 0.70 | 1.20 |
| | Out-of-plane secondary [%] | 0.95 | 0.43 | 1.03 | 0.40 | 1.02 | 2.33 |
| Evaluation by hitting | Operability | 4.0 | 4.1 | 4.1 | 4.0 | 3.0 | 4.0 |
| | Vibration-absorbing performance | 3.8 | 3.0 | 4.0 | 3.1 | 4.0 | 4.5 |

| | | Thickness of rubber | | |
|---|---|---|---|---|
| | | Comparison example ⑥ | Example ⑦ | Comparison example ⑦ |
| Mounting position of dynamic damper | | 0.1L | 0.1L | 0.1L |
| Mounting portion (horizontally or vertically) | | One at left-hand side and one at right-hand side | One at left-hand side and one at right-hand side | One at left-hand side and one at right-hand side side |
| Mass member | kind | 6,6-NY + C | 6,6-NY + C | 6,6-NY + C |
| | Length [mm] | 30 | 30 | 30 |
| | Weight [g] | 3 × 2 | 3 × 2 | 3 × 2 |
| Viscoelastic member | kind | SBR + carbon | SBR + carbon | SBR + carbon |
| | Complex elastic modulus [dyn/cm$^2$] | 3.86E + 08 | 3.86E + 08 | 3.86E + 08 |
| | Thickness [mm] | 1 | 3 | 5 |
| | Weight [g] | 0.5 × 2 | 1.5 × 2 | 2.5 × 2 |
| Weight | [g] | 245 | 245 | 247 |
| Balance | [mm] | 360 | 360 | 359 |
| Moment of inertia | Is (swing direction) [g/cm$^2$] | 467,000 | 467,000 | 473,000 |
| | Ic (center direction) [g/cm$^2$] | 16,400 | 16,400 | 16,800 |
| Vibration-damping factor | Out-of-plane primary [%] | 0.43 | 1.10 | 0.50 |
| | Out-of-plane secondary [%] | 0.44 | 1.95 | 0.50 |
| Evaluation by hitting | Operability | 4.1 | 4.0 | 3.2 |
| | Vibration-absorbing performance | 3.2 | 4.3 | 3.3 |

TABLE 1-continued

| | | Examination of kind of rubber | | | |
|---|---|---|---|---|---|
| | | Comparison example ⑧ | Example ⑧ | Example ⑨ | Comparison example ⑨ |
| Mounting position of dynamic damper | | 0.1L | 0.1L | 0.1L | 0.1L |
| Mounting portion (horizontally or vertically) | | One at left-hand side and one at right-hand side | One at left-hand side and one at right-hand side | One at left-hand side and one at right-hand side | One at left-hand side and one at right-hand side |
| Mass member | kind | 6,6-NY + C | 6,6-NY + C | 6,6-NY + C | 6,6-NY + C |
| | Length [mm] | 30 | 30 | 30 | 30 |
| | Weight [g] | 3 × 2 | 3 × 2 | 3 × 2 | 3 × 2 |
| Viscoelastic member | kind | Silicon | SBR | PEBAX5533 | 11-NYLON |
| | Complex elastic modulus [dyn/cm$^2$] | 1.41 + 07 | 5.07E + 07 | 2.72E + 09 | 1.45E + 10 |
| | Thickness [mm] | 2 | 2 | 2 | 2 |
| | Weight [g] | 1 × 2 | 1 × 2 | 1 × 2 | 1 × 2 |
| Weight | [g] | 245 | 245 | 245 | 245 |
| Balance | [mm] | 360 | 360 | 360 | 360 |
| Moment of inertia | Is (swing direction) [g/cm$^2$] | 467,000 | 467,000 | 467,000 | 467,000 |
| | Ic (center direction) [g/cm$^2$] | 16,400 | 16,400 | 16,400 | 16,400 |
| Vibration-damping factor | Out-of-plane primary [%] | 0.44 | 0.88 | 0.80 | 0.46 |
| | Out-of-plane secondary [%] | 0.45 | 1.60 | 1.45 | 0.48 |
| Evaluation by hitting | Operability | 4.1 | 4.0 | 4.0 | 4.1 |
| | Vibration-absorbing performance | 3.1 | 4.2 | 4.1 | 3.2 |

The racket frame of each of the examples 1 through 9 and the comparison examples 1 through 9 was made of a fiber reinforced thermosetting resin. They were hollow and had the same shape. Each racket frame had a thickness of 28 mm and a width of 13 mm to 16 mm. The area of the ball-hitting plane was 115 square inches. The weight and balance of each racket frame were set as shown in table 1.

More specifically, prepreg sheets (CF prepreg (Toray T300, 700, 800, M46J)) made of the fiber reinforced thermosetting resin containing carbon fibers as the reinforcing fiber thereof were layered at angles of 0°, 22°, 30°, and 90° on a mandrel (ϕ14.5) coated with a pressurized tube made of nylon 66 to form a straight laminate of the prepreg sheets. After the mandrel was removed from the laminate, the laminate was set in a die. The die was clamped and heated to 150° for 30 minutes, with an air pressure of 9 kgf/cm$^2$ kept applied to the inside of the pressurized tube to form the racket frame of each of the examples and comparison examples.

In the example 3, in penetration through the grip part, the mounting hole 20 was formed at two positions which were opposed to each other in the direction orthogonal to the ball-hitting plane F in such a way that the dynamic damper-mounting holes 20 were formed on a plane including the axis of the grip part and parallel with the ball-hitting plane F. In the examples other than the example 3 and the comparison examples 1 through 9, in penetration through the grip part, mounting holes 20 were formed in penetration through the grip part at two positions which were opposed to each other in the widthwise direction of the grip part in such a way that the dynamic damper-mounting holes 20 are formed on a plane including the axis of the grip part and parallel with the ball-hitting plane F.

In the racket frame of each of the examples and the comparison examples, the dynamic damper was fixed to the inner surface of the grip part 15 by mounting the flat separable grip member 35, made of the fiber reinforced thermosetting resin, on which the dynamic damper was mounted on the dynamic damper-mounting hole 20.

Example 1

The configuration and construction of the dynamic damper; the mounting portion thereof (horizontally or vertically); the material, length, and weight of the mass member; and the material, complex elastic modulus, thickness, and weight of the viscoelastic member were the same as those of the first embodiment. That is, the dynamic damper was formed by winding the viscoelastic member 32 around the small-diameter portion 31*a* formed at the central portion of the rod-shaped mass member 31 in the longitudinal direction thereof. The dynamic damper was mounted inside the grip part at left and right positions thereof opposed to each other in the widthwise direction thereof. The mass member 31 was made of nylon 66 containing short carbon fibers at 22%. The mass member 31 had a length of 30 mm and a weight of 3 g. The sheet-shaped viscoelastic sheet 32 was formed by vulcanizing and molding a rubber composition containing 100 parts by weight of styrene-butadiene rubber, 1.5 parts by weight of sulfur, and 40 parts by weight of carbon black. The viscoelastic member had a complex elastic modulus of 3.86E+08 dyn/cm$^2$ when the complex elastic modulus was measured in the above-described conditions. The viscoelastic sheet 32 had a thickness of 2 mm and a weight of 1 g. The dynamic damper was mounted at the position of 0.1 L from the free end of the grip part 15, supposing that the whole length of the racket frame is L.

Example 2

The racket frame of the example 2 had the same construction as that of example 1 except that the dynamic damper was mounted at the position of 0.2 L from the free end of the grip part 15, supposing that the whole length of the racket frame is L.

Example 3

The racket frame of the example 3 had the same construction as that of example 1 except that the dynamic damper was mounted at the upper and lower positions of the grip part 15.

Example 4

The racket frame of the example 4 had the same construction as that of example 1 except that the mass member was made of nylon 11 and that the weight of one mass member was 1.5 g.

Example 5

The racket frame of the example 5 had the same construction as that of example 4 except that the length of the mass member was 45 mm and that the weight of one mass member was 2 g.

Example 6

The racket frame of the example 6 had the same construction as that of example 1 except that the mass member was made of rubber containing nylon 66 and powder of tungsten and that the weight of one mass member was 4 g.

Example 7

The racket frame of the example 7 had the same construction as that of example 1 except that the thickness of the viscoelastic member was 3 mm and that the weight of one viscoelastic member was 1.5 g.

Example 8

The racket frame of the example 8 had the same construction as that of example 1 except that the viscoelastic member was formed by molding and vulcanizing a rubber composition containing 100 parts by weight of styrene-butadiene rubber and 1.5 parts by weight of sulfur and that its complex elastic modulus was 5.07E+7 dyn/cm$^2$ when the complex elastic modulus was measured in the above-described conditions.

Example 9

The racket frame of the example 9 had the same construction as that of example 1 except that the viscoelastic member was made of PEBAX5533 and that its complex elastic modulus was 2.72E+9 dyn/cm$^2$ when the complex elastic modulus was measured in the above-described conditions.

Comparison Example 1

No dynamic damper was mounted on the racket frame of the comparison example 1. Instead, a lead, having a weight of 6 g, for adjusting the weight balance was mounted inside the grip part.

Comparison Example 2

The racket frame of the comparison example 2 had the same construction as that of example 1 except that the dynamic damper was mounted at the position of 0.3 L from the free end of the grip part.

Comparison Example 3

The racket frame of the comparison example 3 had the same construction as that of example 1 except that the mass member was made of copper and that the length of the mass member was 15 mm.

Comparison Example 4

The racket frame of the comparison example 4 had the same construction as that of example 1 except that the mass member was made of nylon 11 and that the length of the mass member was 60 mm.

Comparison Example 5

The racket frame of the comparison example 5 had the same construction as that of example 1 except that the mass member was made of copper and that the weight of one mass member was 6 g.

Comparison Example 6

The racket frame of the comparison example 6 had the same construction as that of example 1 except that the thickness of the viscoelastic member was 1 mm and that the weight of one viscoelastic member was 0.5 g.

Comparison Example 7

The racket frame of the comparison example 6 had the same construction as that of example 1 except that the thickness of the viscoelastic member was 5 mm and that the weight of one viscoelastic member was 2.5 g.

Comparison Example 8

The racket frame of the comparison example 8 had the same construction as that of example 1 except that the viscoelastic member was made of silicone rubber and that its complex elastic modulus was 1.41E+7 dyn/cm$^2$ when the complex elastic modulus was measured in the above-described conditions.

Comparison Example 9

The racket frame of the comparison example 9 had the same construction as that of example 1 except that the viscoelastic member was made of nylon 11 and that its complex elastic modulus was 1.45E+10 dyn/cm$^2$ when the complex elastic modulus was measured in the above-described conditions.

Measurement of Moment of Inertia

Figure 9A:
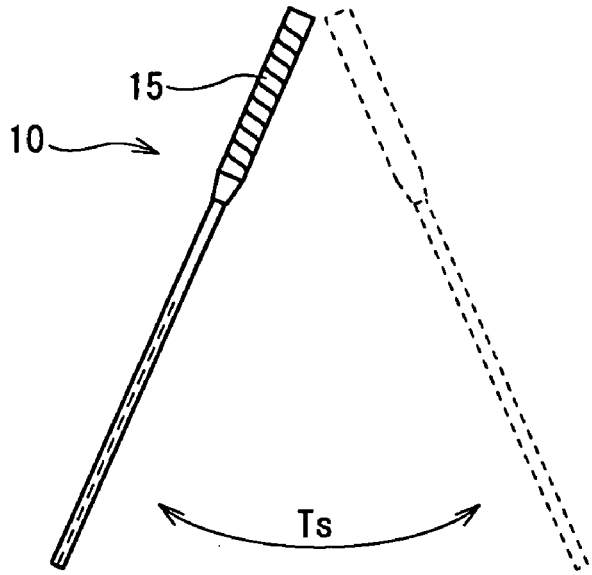
FIGS. 9A and 9B are a schematic view respectively showing the method of measuring the moment of inertia of the racket frame.

As shown in FIG. 9A, required accessory parts were mounted on each racket frame. Each tennis racket was hung, with the grip part 15 located uppermost to measure the swing period Ts by an apparatus for measuring the moment of inertia. The moment of inertia in the swing direction (moment of inertia in swing in out-of-plane direction which is made about the grip end) was calculated by the following equations.

Figure 9B:
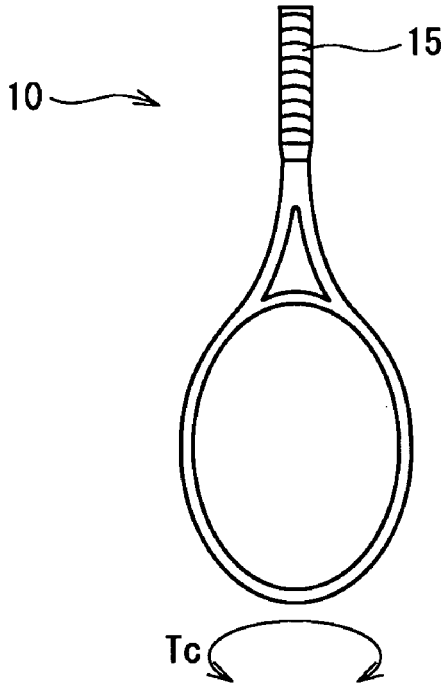

As shown in FIG. 9B, each tennis racket was hung, with the grip part 15 located uppermost to measure a center period Tc by an apparatus for measuring the moment of inertia. The moment of inertia in the center direction and the moment of inertia around the center of gravity were calculated by the following equations.

Computation of Moment of Inertia

Swing direction: Is [g/cm$^2$]

$$Is=M\times g\times h(Ts/2/\pi)^2-Ic$$

Center direction: Ic [g/cm$^2$]

$$Ic=254458\times(Tc/\pi)^2-8357$$

Around center of gravity: Ig $$Ig=Is-m(l+2.6)^2$$

In the above equation, M=m+mc, h=(m×l−mc×lc)/m+2.6, m: weight of racket, l: balance point of racket, mc: weight of chuck, and lc: balance point of chuck.

Measurement of Out-Of-Plane Primary Vibration Damping Factor

Figure 10A:
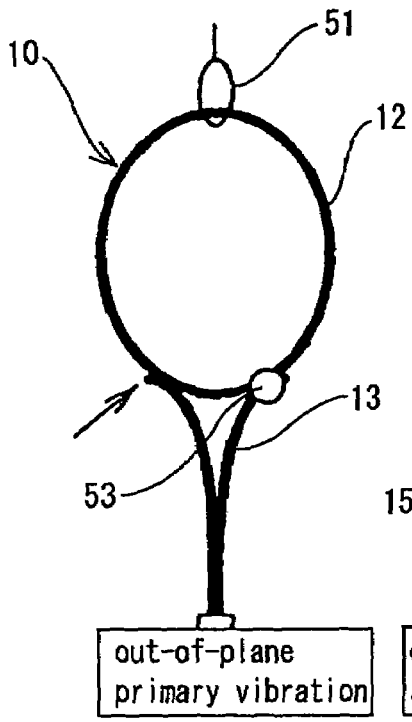
FIGS. 10A, 10B, and 10C are a schematic view respectively showing the method of measuring the vibration-damping factor of the racket frame.

As shown in FIG. 10A, the upper end of the head part 12 of the racket frame of each of the examples and the comparison examples was hung with a cord 51. An acceleration pick-up meter 53 was mounted on one connection portion between the head part 12 and the throat part 13, with the acceleration pick-up meter 53 disposed perpendicularly to the ball-hitting plane of the racket frame. As shown in FIG. 10B, in this state, the other connection portion between the head part 12 and the throat part 13 was hit with an impact hammer 55 to swing the racket frame. An input vibration (F) measured by a force pick-up meter mounted on the impact hammer 55 and a response vibration (α) measured by the acceleration pick-up meter 53 were inputted to a frequency analyzer 57 (dynamic single analyzer HP3562A manufactured by Hewlett Packard Inc.) through amplifiers 56A and 56B. A transmission function in a frequency region obtained by the analysis was computed to obtain the frequency of the tennis racket. The vibration-damping ratio (ζ) of the tennis racket, namely, the out-of-plane primary vibration-damping factor thereof was computed by an equation shown below. The out-of-plane primary vibration-damping factor of the racket frame of each of the examples and the comparison examples shown in Table 1 is the average of measured values.

$$\zeta=(1/2)\times(\Delta\omega/\omega n)$$

$$To=Tn/\sqrt{2}$$

Measurement of Out-Of-Plane Secondary Vibration-Damping Factor

Figure 10C:
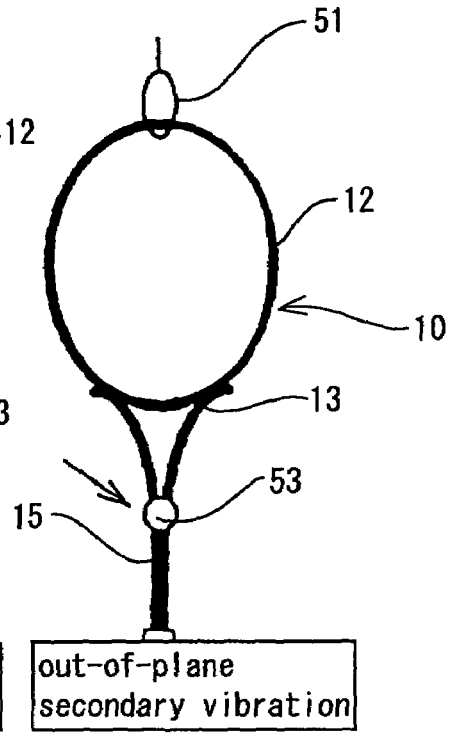
Figure 10B:
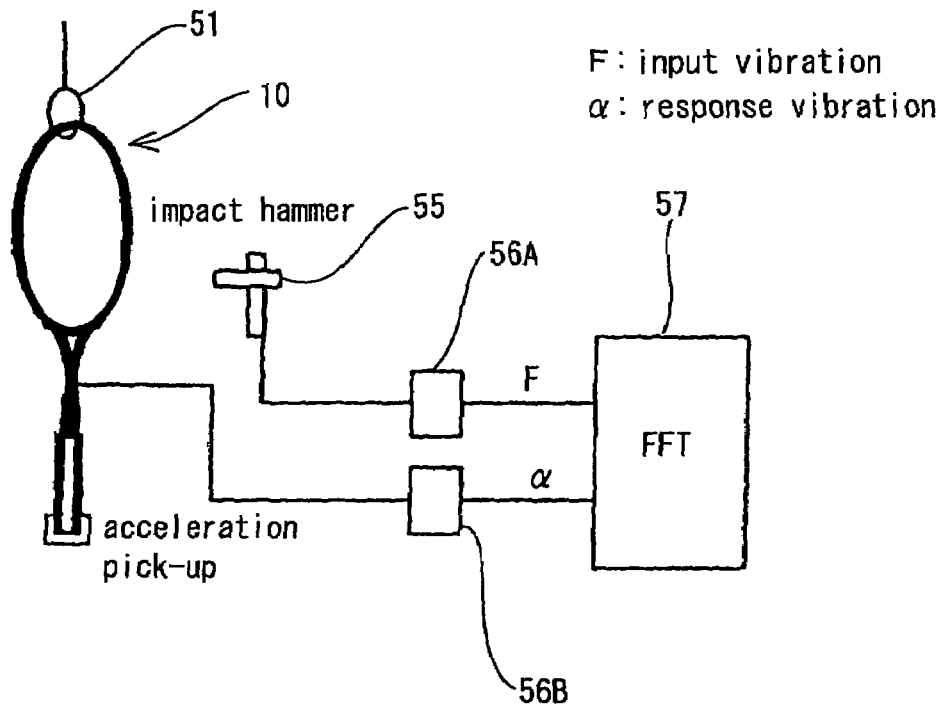
Figure 11:
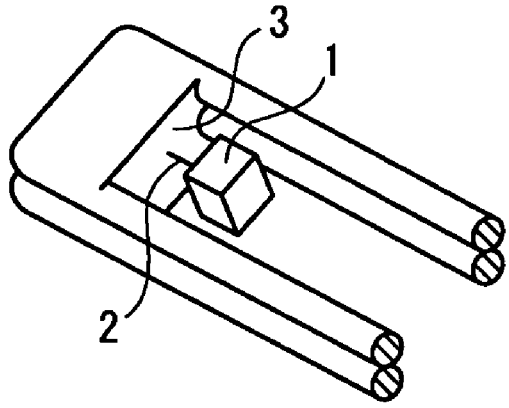
FIG. 11 shows a conventional art.
Figure 12:
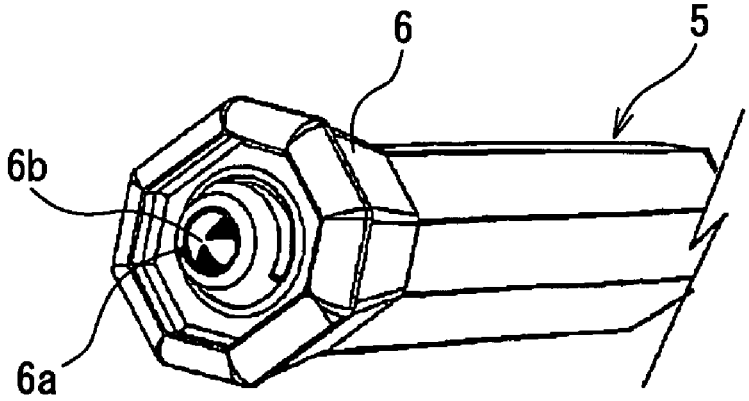
PRIOR ART Fig. 12
FIG. 12 shows another conventional art.
Figure 13:
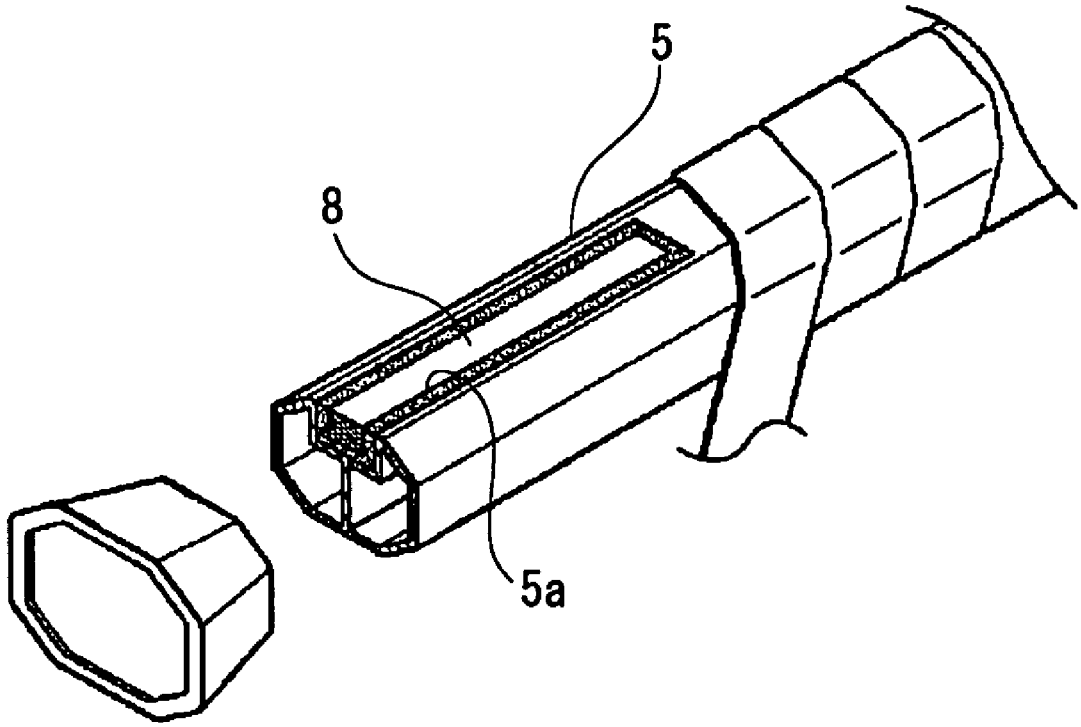
FIG. 13 shows still another conventional art.

As shown in FIG. 10C, the upper end of the head part 12 of the racket frame of each of the examples and the comparison examples was hung with the cord 51. The acceleration pick-up meter 53 was mounted on one connection portion between the throat part 13 and the shaft part 14, with the acceleration pick-up meter 53 disposed perpendicularly to the ball-hitting plane of the racket frame. In this state, the rear side of the position of the racket frame 10 at which the acceleration pick-up meter was mounted was hit with the impact hammer 55 to swing the tennis racket. The vibration-damping factor, namely, the out-of-plane secondary vibration-damping factor of the racket frame was computed by a method equivalent to the method of computing the out-of-plane primary vibration-damping factor. The out-of-plane secondary vibration-damping factor of the racket frame of each of the examples and the comparison examples shown in Table 1 is the average of measured values.

Questionnairing was conducted on the operability and the vibration-absorbing performance of each racket frame. 38 middle and high class female players (who have not less than 10 year' experience in tennis and play tennis three or more days a week currently) were requested to hit balls with the rackets and give marks on the basis of five (the more, the better). Table 1 shows the average of marks given by them.

As indicated in table 1, the racket frame of each of the examples 1 and 2 in which the dynamic damper was mounted at a position within the range of 0.2 L from the free end of the grip part had a high vibration-damping factor. The racket frame of the comparison example 2 in which the dynamic damper was mounted at a position out of the range of 0.2 L from the free end of the grip part had a low vibration-damping factor. This is because the dynamic damper was mounted at the position of the node of vibration. Thus the racket frame of the comparison example 2 had a low performance in the ball-hitting test. It was found that the racket frame of the example 3 in which the dynamic damper was mounted at the upper and lower positions of the grip part had a vibration-damping effect equal to that of the racket frame of the examples 1 and 2 in which the dynamic damper was mounted at the left and right positions of the grip part.

The racket frames of each of the examples 1, 4, 5, and 6 and the comparison example 5 in which the length of the mass member was not less than 2 cm nor more than 5 cm had a high vibration-damping factor. On the other hand; the racket frame of the comparison example 3 in which the length of the mass member was shorter than 2 cm had a low vibration-damping factor, because the frequency of the mass member was uncoincident with that of the racket frame. The racket frame of the comparison example 4 in which the length of the mass member was longer than 5 cm had a low vibration-damping factor. In addition the mass member collided with the inner wall of the grip part, thus causing generation of noise.

The racket frame of the comparison example 5 in which the total weight of the two mass members was more than log had a high vibration-damping factor, but had a low evaluation on the operability thereof. This is because the racket frame was heavy.

The racket frame of each of the examples 1 through 7 in which the viscoelastic member had a thickness not less than 2 mm nor more than 4 mm had a high vibration-damping factor. The racket frame of the comparison example 6 in which the viscoelastic member had a thickness less than 2 mm had a low vibration-damping factor. This is because the frequency of the dynamic damper was uncoincident with that of the racket frame. In addition, the amplitude of the mass member was so large that the mass member caused generation of noise. The racket frame of the comparison example 7 in which the viscoelastic member had a thickness more than 4 mm had a low vibration-damping factor and had a low evaluation on the operability thereof, because the racket frame was heavy.

The viscoelastic member of the racket frame of the comparison example 8 made of silicon had a complex elastic modulus less than 2.0E+07 dyn/cm$^2$. The viscoelastic member of the racket frame of the comparison example 9 made of nylon 11 had a complex elastic modulus more than 1.0E+10 dyn/cm$^2$. Therefore the viscoelastic member of the former was too soft, whereas that of the latter was too hard. Thereby both dynamic dampers had a low vibration-damping factor because there was non-coincidence between the frequency of the dynamic damper and the racket frame in each of the racket frames of comparison examples 8 and 9. On the other hand, the viscoelastic member of the racket frame of each of the examples had a complex elastic modulus in the range of not less than 2.0E+07 dyn/cm$^2$ nor more than 1.0E+10 dyn/cm$^2$. Thus the racket frame of each of the examples had a high vibration-damping factor and had a high evaluation in the ball-hitting test.

The racket frame of the present invention is applicable to regulation-ball tennis. In addition the racket frame is also applicable to softball tennis, badminton, squash, and the like.

What is claimed is:

1. A racket frame comprising a grip part, a shaft part, a throat part, and a head part formed with a fiber reinforced resin so as to be hollow and having a weight not less than 100 g nor more than 270 g, said racket frame being provided with a dynamic damper comprising a rod-shaped mass member and a viscoelastic member in the form of a sheet mounted on a part of a peripheral surface of said rod-shaped mass member;

wherein said dynamic damper is mounted inside said grip part by fixing said viscoelastic member to a position of an inner wall of said grip part located within a range of 0.2 L from a free end of said grip part, supposing that a whole length of said racket frame is L in such a way that inside said grip part, at least one part of said mass member is shakable with respect to said inner wall of said grip part; and wherein both end portions of said rod-shaped mass member are shapable;

said rod-shaped mass member having a length not less than 2 cm nor more than 5 cm and a weight not less than 2 g nor more than 10 g, and said viscoelastic member being wound around a small diameter portion formed at a central portion of said rod-shaped mass member in a longitudinal direction thereof.

2. The racket frame according to claim 1, wherein said viscoelastic member has a thickness not less than 2 mm nor more than 4 mm and a complex elastic modulus not less than 2.0E+07 dyn/cm$^2$ nor more than 1.0E+10 dyn/cm$^2$ at a temperature in a range of 0° C. to 10° C. when said complex elastic modulus is measured at a frequency of 10 Hz.

3. The racket frame according to claim 2, wherein a dynamic damper-mounting hole is formed on a portion of a wall surface of said grip part; said viscoelastic member of said dynamic damper is fixed to an inner surface of a separable grip member made of fiber reinforced resin; and said dynamic damper-mounting hole is closed with said separable grip member in such a way that said separable grip member and an outer surface of said grip part are flush with each other.

4. The racket frame according to claim 1, wherein a dynamic damper-mounting hole is formed on a portion of a wall surface of said grip part; said viscoelastic member of said dynamic damper is fixed to an inner surface of a separable grip member made of fiber reinforced resin; and said dynamic damper-mounting hole is closed with said separable grip member in such a way that said separable grip member and an outer surface of said grip part are flush with each other.

5. A racket frame comprising a grip part, a shaft part, a throat part, and a head part formed hollowly with a fiber reinforced resin and having a weight not less than 100 g nor more than 270g, said racket frame is provided with a dynamic damper comprising a mass member and a viscoelastic member mounted on a part of a peripheral surface of said mass member;

wherein said dynamic damper is mounted inside said grip part by fixing said viscoelastic member to a position of an inner wall of said grip part located within a range of 0.2 L from a free end of said grip part, supposing that a whole length of said racket frame is L in such a way that inside said grip part, at least one part of said mass member is shakable with respect to said inner wall of said grip part; and wherein said viscoelastic member has a thickness not less than 2mm nor more than 4mm and a complex elastic modulus not less than 2.0E +07 dyn/cm$^2$ nor more than 1.0E +10 dyn/cm$^2$ at a temperature in a range of 0° C. to 10° C. when said complex elastic modulus is measured at a frequency of 10 Hz.

6. The racket frame according to claim 5, wherein a dynamic damper-mounting hole is formed on a portion of a wall surface of said grip part; said viscoelastic member of said dynamic damper is fixed to an inner surface of a separable grip member made of fiber reinforced resin; and said dynamic damper-mounting hole is closed with said separable grip member in such a way that said separable grip member and an outer surface of said grip part are flush with each other.

7. A racket frame comprising a grip part, a shaft part, a throat part, and a head part formed hollowly with a fiber reinforced resin and having a weight not less than 100 g nor more than 270 g, said racket frame is provided with a dynamic damper comprising a mass member and a viscoelastic member mounted on a part of a peripheral surface of said mass member;

wherein said dynamic damper is mounted inside said grip part by fixing said viscoelastic member to a position of an inner wall of said grip part located within a range of 0.2 L from a free end of said grip part, supposing that a whole length of said racket frame is L in such a way that inside said grip part, at least one part of said mass member is shakable with respect to said inner wall of said grip part; and wherein a dynamic damper-mounting hole is formed on a portion of a wall surface of said grip part; said viscoelatic member of said dynamic damper is fixed to an inner surface of a separable grip member made of fiber reinforced resin; and said dynamic damper-mounting hole is closed with said separable grip member and an outer surface of said grip part are flush with each other.

* * * * *